US006317041B1

(12) United States Patent
Singer et al.

(10) Patent No.: US 6,317,041 B1
(45) Date of Patent: Nov. 13, 2001

(54) REFUGE BAY MONITORING SYSTEM

(75) Inventors: Asher Singer; Andy Steenkamp, both of Benoni (ZA)

(73) Assignee: C.T. Systems CC, Pretoria (ZA)

( * ) Notice: Subject to any disclaimer, the term of this patent is extended or adjusted under 35 U.S.C. 154(b) by 0 days.

(21) Appl. No.: 09/496,436

(22) Filed: Feb. 2, 2000

(51) Int. Cl.[7] ..... G08B 1/08

(52) U.S. Cl. ..... 340/539

(58) Field of Search ..... 340/506, 571, 340/524, 525, 531, 532, 632, 825.06, 825.36, 825.49, 286.02, 286.06, 287

(56) References Cited

U.S. PATENT DOCUMENTS 4,606,219 * 8/1986 Bout et al. ..... 73/23

* cited by examiner

*Primary Examiner*—Daryl Pope
(74) *Attorney, Agent, or Firm*—Lloyd L. Zickert

(57) ABSTRACT

A refuge bay monitoring system including a radio system connected to a computer in an above-ground control room, and a controller connected to a radio system in a below-ground refuge bay or safe area for mine workers. The controller monitors the operation of equipment in the refuge bay and any doors to the refuge bay. The refuge bay radio system communicates with the radio system in the above-ground control room so the computer can monitor the refuge bay. The radio systems provide intercommunication for data and voice.

7 Claims, 1 Drawing Sheet

REFUGE BAY MONITORING SYSTEM

This invention relates in general to a rescue monitoring system for an underground mine, and more specifically, to a system and its use to monitor the status of equipment and workers within a refuge bay or safe area in a mine.

BACKGROUND OF THE INVENTION

Fixed or immovable safe areas like refuge bays are a safety necessity for workers within a potentially dangerous environment, such as underground mines. Persons present at any location where unsafe conditions could be present should have access to a safe area when life endangering circumstances occur. Dangerous conditions may be caused by a variety of incidents like fires causing smoke and thus low visibility, escaping gases, heavy equipment failures, structure failures, earth cave-ins, and the like.

Unsafe places where fires are caused by combustible materials present, including open flames, spontaneous combustion, electricity, friction, blasting, and the like may endanger persons in that same environment and may cause considerable economic losses. In the event of an accident, personnel must immediately evacuate to the nearest safe location like a refuge bay as one possible solution.

Refuge bays in the mining industry are one of the safety necessities for personnel operating and maintaining the mine operations. Safe locations are established as soon as possible and may be located at short distances from each other in order to be reached quickly.

Safe locations usually consist of a refuge bay with one or more entrances. The entrance to the refuge bay should preferably be closed in an attempt to prevent the accumulation of dust, dangerous gases, and other undesirable elements within the refuge bay. The refuge bay may be equipped with a battery pack, battery charger, a fan, first aid kits, canisters with consumable fluids, an alarm, safety, medical and other survival equipment. Some refuge bays may have a means of assuring a flow of fresh air to the refuge bay, for example, an extended pipe or a link to the surface through a borehole pipe if the refuge bay is below the surface. Refuge bays should be inspected periodically to assure that the working condition of the equipment is acceptable. Disadvantages of the present inspections are that the entrances of the refuge bay may have been open for long periods, causing the accumulation of dust and/or other undesirable elements within the refuge bay. This may damage the equipment; for example, the ventilating fan for providing fresh air or the battery charger that maintains battery power.

A further disadvantage of the conditions present in such refuge bays is the lack of effective communication systems for locating the refuge bay sheltering workers.

SUMMARY OF THE INVENTION

In general, the invention is based on an intelligent monitoring system mounted within the refuge bay and powered from any source of suitable power available that communicates with an above-ground system. The system would include a controller unit in any suitable enclosure with a front panel having a test button, a panic button, a suitable data display window, a speaker, a microphone and a push to talk button. The above-mentioned components may be arranged in any suitable way without having a material effect on the functioning of the controller unit. A radio transceiver may be mounted or placed in the near vicinity of and connected to the controller unit. The radio may be electrically connected to the controller unit through a link of serial communication, abbreviated as RS 232, as one example for a workable form of connection. The antenna or input/output of the radio may be hardwired through the same means of assuring a flow of fresh air to the refuge bay, for example, an extended pipe or a link to the surface through a borehole pipe if the refuge bay is below the surface. However, it need not be hardwired if favorable conditions for wireless communication are present. It will be appreciated that normally the refuge bay will be located underground, but in some operations it may be above ground. The radio may operate on the same frequency as other radios, but a different transmission code for each refuge bay would be provided where there would be a plurality of refuge bays. It is preferred that the radio transmitter is operational and in a state of continuous transmission in order to obtain the most effective results.

A principal object of the present invention is to provide an accurate and effective means whereby a security person is informed about the status and condition of equipment and human presence within a refuge bay to enhance a safe working environment for workers.

Another object of the invention is to provide a cost effective means of timely alerting and/or timely indicating when a dangerous situation has occurred and wherein accordingly the invention will identify the location of the nearest refuge bay, thereby providing a safe and effective manner of locating the refuge bay.

Another object of the invention is to monitor the operation and proper functioning of equipment in a refuge bay like the condition of a battery, battery charger, fan, alarm, communication links, the egress frequency, and opening of doors at entrances wherein the said invention is to provide a monitoring means without any physical moving parts.

Another object of the present invention is to provide a fast and effective way of informing a security person of the presence of any worker or person in the refuge bay or any other unauthorized entry in the refuge bay.

Another object of the present invention is to provide a safe and effective way of monitoring and controlling the performance or non-performance of the equipment installed in the refuge bay.

Another object of the present invention is to provide a security person with a safe and reliable monitoring system or arrangement to have correct information regarding the operational functionality of the equipment within the refuge bay and be alerted in cases when a change in the operational functionality should occur.

Other objects of the invention are to provide a monitoring system which is simple in design, inexpensive to manufacture, precise in construction, easy to use and efficient in operation.

These and other objects, advantages and novel features of the present invention will be readily evident upon a study of the following detailed description and specification when considering in conjunction with the accompanying drawings.

DESCRIPTION OF THE INVENTION

Figure 1:
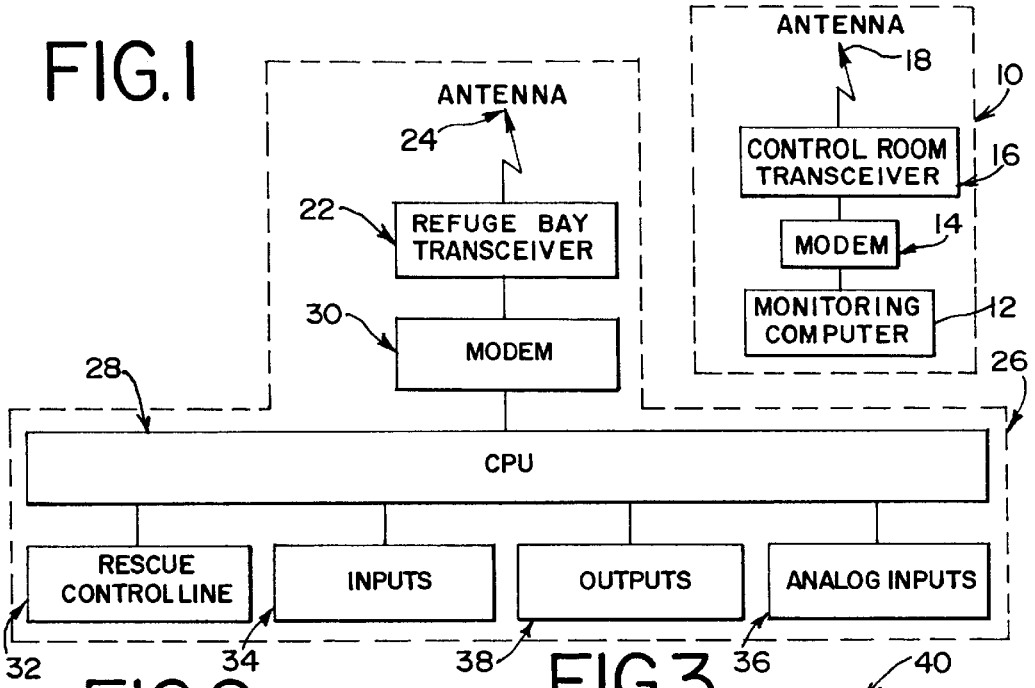
FIG. 1 is a block diagram of the refuge bay monitoring system according to the invention.

Each refuge bay or safe area would include a controller in communication with a control room monitored by security personnel. An entrance of each refuge bay would usually include a closure means such as a swinging or sliding door. Each entrance would also be equipped with limit switches detecting and indicating door position to the controller and in particular, the central processing unit (CPU) 4, via the inputs 6. In the event of opening the closure means at the entrance, the movement would activate the limit switch and the controller may transmit a signal to a control room, followed either by a test or a panic signal or by no signal at all. The controller may transmit a test signal if the test push button is manually activated by an authorized entry of a worker, or the controller may transmit a panic signal if the panic push button is manually activated by workers seeking shelter within the refuge bay. The refuge bay may be identified by means of the transmitted panic signal. The transmitted signal followed by a manual pushing of the panic push button may initiate the controller to activate automatically, the fan of the refuge bay via the outputs 7, the audio visual alarms via outputs 7, the transmission of signals to the control room, and may convert the radio from data transmission mode to voice communication mode.

In cases where the transmitter signal as initiated by the limit switch is not followed by any other signal, it may be concluded that the closure means at the entrance of the refuge bay was opened accidentally or by an unauthorized person.

The controller may monitor the working condition of the battery charger via inputs 6 in a digital mode and may monitor the source of power or battery level in an analog mode via the analog inputs 7 measured in volts. The controller may periodically start the fan via the outputs 8 and the controller may monitor the current of the fan through the analog inputs measured in amperes. The controller may thus confirm that the fan is operational. A further application would be that the controller may monitor the working condition and may periodically start the audio visual alarms via the outputs 7 and the controller may monitor the working condition of the audio visual alarms via analog inputs 8 in a digital mode measured in amperes.

In the control room at a remote location from the refuge bay, a radio system may be mounted and connected to a personal computer. Under normal conditions the computer in the control room may poll periodically each refuge bay to confirm that the link of communication has not been interrupted and may receive from the controller in each refuge bay a confirmation test and monitoring conditions performed by the controller. The transmissions emitted may be logged and stored in memory in order in the computer to be viewed in the control room.

Thus, there is provided a rescue monitoring system that comprises a helpful means in all fields and applicable disciplines that is both cheaper and simpler to manufacture and offers performance advantages compared to conventional similar monitoring systems.

Referring particularly to the drawings, it will be seen in FIG. 1 that the above-ground rescue safety control room is generally designated by the numeral 10 and includes a monitoring computer 12 connected to a modem 14 that is in turn connected to a transceiver 16. The monitoring computer will be provided with the necessary software for providing periodic monitoring functions of the environmental equipment in one or more refuge bays or safe areas that are underground and which sense and receive signals through the modem 14 and the transceiver 16. The transceiver includes a suitable antenna/output 18 which along with the transceiver allows communication with a refuge bay transceiver 22 through an antenna/output 24. The antenna/outputs may be hardwired together or wireless.

The underground refuge bay or safe area is generally represented by the numeral 26 and includes a central processing unit (CPU) 28 connected through a modem 30 and the transceiver 22 for sensing and receiving signals and communicating with the control room 10. It will be appreciated that in addition to the control room transceiver 16 and the refuge bay transceiver 22 having the ability to sense and receive signals from the corresponding computer and processing unit, suitable equipment is provided for allowing voice contact between the control room and refuge bay through the transceivers.

The CPU 28 receives signals from a rescue control line 32, digital inputs 34, and analog inputs 36 while generating signals to the digital outputs 38.

Figure 3:
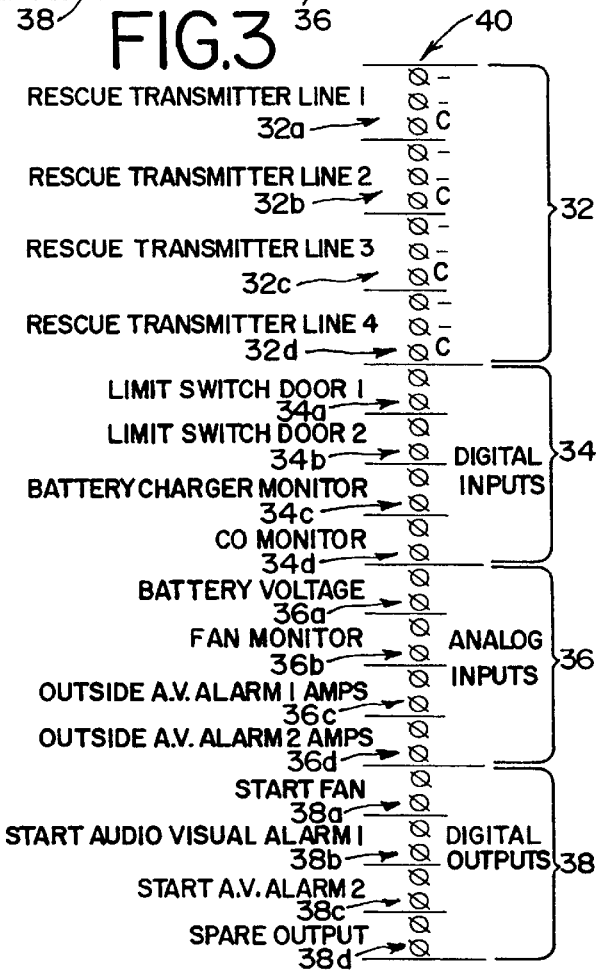
FIG. 3 is a diagrammatic view of the terminal connections for the controller in the refuge bay to further a proper explanation of the invention.

Through a populated component board (PCB) a termination board 40, as seen in FIG.3, includes the rescue control or transmitter lines 32, the digital inputs 34, the potentially free or spare inputs/outputs or analog inputs 36, and the digital outputs 38.

The rescue control or transmitter line includes rescue transmitter line 32*a,* rescue transmitter line 32*b,* rescue transmitter line 32*c,* and rescue transmitter line 32*d.*

The digital inputs include a limit switch 34*a* for door No. 1, a limit switch 34*b* for door No. 2, a battery charger monitor 34*c,* and a carbon monoxide monitor 34*d.*

The analog inputs 36 include a battery voltage monitor 36*a,* a fan monitor 36*b,* and audio visual alarms 36*c* and 36*d.*

The digital outputs 38 include a fan operation output 38*a,* an audio visual alarm output 38*b* for one alarm, an audio visual output 38*c* for another alarm, and a spare output 38*d* for connection to another type of signal generating device.

Figure 2:
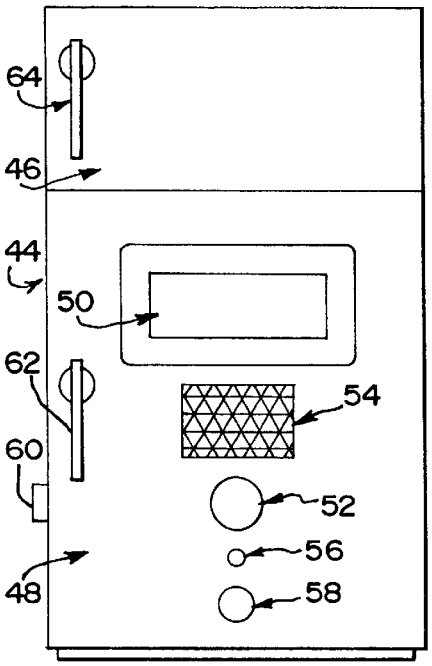
FIG. 2 is a front elevational view of the control panel mounted in the refuge bay.

An enclosure or cabinet for the controller in the refuge bay is shown in FIG. 2 and generally indicated by the numeral 44 and which includes a compartment 46 for the transceiver and a compartment 48 for the CPU. The termination board as shown in FIG. 3 will be provided on the enclosure 44. The front panel of the enclosure includes a display 50 for the rescue lines 32. Further, the front panel of the enclosure includes a panic push button 52, a speaker 54, a microphone 56, and a press to talk transceiver button 58. Further, a test push button 60 is provided along one side of the front panel to the CPU compartment which may be opened by operating a padlockable handle 62. Similarly, a padlockable handle 64 is provided on the door for opening the transceiver compartment.

It will be appreciated that refuge bays are provided in underground mines as a safety necessity for the workers operating and maintaining the mine operation. Any number of refuge bays may be provided such as one refuge bay for each kilometer of mine development, and no further than about a twenty-minute walk from the working face of the mine. Usually, each refuge bay would include two entrances, one of which would be close to the conveyer path in the mine and the other adjacent to the return airway. Of course, any number of airways may be provided depending upon the extent of the mine development. Each entrance to a refuge bay or safe area would normally include a closure means, such as a door, which must be kept closed at all times but not locked, thereby preventing the accumulation of dust or dangerous gases within the refuge bay.

Each refuge bay is equipped with a fan connected to an airway for providing outside fresh air to the refuge bay, a battery pack for operating the fan and other equipment, a battery charger for maintaining the battery pack at an acceptable level of power. The battery charger would be powered from the main electrical lines in the mine. Additionally, each refuge bay may include a first aid kit and adequate drinking water together with suitable benches or furniture on which the mine workers may sit.

Outside each door to a refuge bay an audio visual alarm would be provided. Normally, the refuge bays are periodically visited to monitor the condition of the equipment, although such manual checkups are not adequate to provide a reliable determination of the condition of the equipment and the refuge bay. For example, if one or more of the doors of the refuge bay has been left open for any reason dust can accumulate within the refuge bay and cause damage to the equipment. The equipment, such as a fan or battery charger, may then cease to operate. Moreover, heretofore known refuge bays have not had adequate communication with above-ground stations in case of emergencies, and particularly to alert above-ground personnel as to which refuge bay workers have occupied.

Preferably, the antenna of the radio in the refuge bay will be hardwired through the borehole pipe of the mine to the surface. Although radios of all of the refuge bays will operate on the same frequency, each radio will have a different transmission code for differentiation in the control room.

The controller 44 within the refuge bay will monitor the condition of the battery charger in a digital mode and the battery power level in an analog mode. A carbon monoxide monitor will be mounted inside the refuge bay in order to detect the accumulation of carbon monoxide from the ventilation pipe due to a fire in the many passages in the mine or from any other sources underground. The controller will monitor the carbon monoxide level to compare it with a preset level. Should that carbon monoxide level exceed the preset level, a signal will be received by the controller and transmitted directly to the above-ground security control room as well as to activate the audio visual alarm mounted outside of the refuge bay.

Periodically, the controller will start the fan and that operation will be monitored to confirm that the fan is operational. Similarly, the controller will periodically operate the audio visual alarms and likewise confirm that these alarms are operational. This data will be communicated to the control room.

In the above-ground control room, the monitoring computer will periodically poll each refuge bay confirming that the communication with each refuge bay is sound and also confirming the test and monitoring conditions performed by the controller. Preferably, each transmission of these events will be logged and printed, and the operator in the control room will be able to confirm on the display that the communication between the refuge bay and the above-ground controller is operational.

Should someone open one of the refuge bay doors, the limit switch for that door will be triggered, and a signal will be transmitted from the controller to the above-ground control room. The operator in the control room will monitor the event to determine if the entry was authorized and which would be confirmed either by the person entering by pressing the test button or the panic button. If neither the test button nor panic button is depressed within a given period of time, that would indicate to the above-ground operator that the door was accidentally opened or opened by an unauthorized person. Suitable action could then be taken to deal with the situation. It will be appreciated that following a preset time, such as by a delay timer after the door is opened, should the controller in the refuge bay ascertain that no signal on the controller has been activated, it will automatically activate the audio visual alarm outside the refuge bay. Should a test signal be transmitted by the controller, it would denote that an authorized person entered the refuge bay for a checkup of the condition in the refuge bay. Should the panic signal be transmitted to the control room upon depressing of the panic button 52, the operator will follow the predesignated appropriate steps of informing the mine management of a disaster underground and the operator will identify the location of the refuge bay where workers are assembled. Further, once the panic button is pushed and activated due to a distress condition, the controller in the refuge bay will automatically activate the fan and audio visual alarms as well as transmit the panic signal to the control room. Further, the controller will automatically change the transceiver from a data transmission mode to a voice communication mode.

In view of the foregoing, it will be appreciated that the refuge bay monitoring system of the present invention provides a high degree of safety for underground mine workers.

It will be understood that modifications and variations may be effected without departing from the scope of the novel concepts of the present invention, but it is understood that this application is to be limited only by the scope of the appended claims.

The invention is hereby claimed as follows:

1. In combination with an above-ground rescue/safety control room having a radio system connected to a monitoring computer, a refuge bay system for monitoring the conditions at a below-ground refuge bay and communicating the conditions to the control room, wherein the refuge bay includes a fan, a battery pack, a battery charger, and door means, and audio-visual alarm means outside the refuge bay, said refuge bay system comprising a controller and a radio means, said controller having electronic means for monitoring the operation of the fan, the battery charger and the door means, and for operating said fan, said alarm means and said radio means, said radio means communicating the controller monitored operations to said radio system of the control room, manually operable panic means on said controller for activating the fan and audio-visual alarm means, transmitting a panic signal to said control room, and converting the transmission mode of the radio means from data to voice.

2. The combination of claim 1, wherein said controller further includes manually operable test means coacting with said electronic means to provide information to the control room.

3. The combination of claim 1, wherein said controller electronic means further includes means for monitoring a CO detector and communicating the CO level to the control room.

4. The combination of claim 1, wherein said controller electronic means includes means for activating the alarm means following a predetermined time interval following the opening of said door means.

5. The combination of claim 1, wherein the monitoring computer in the control room will periodically poll the integrity of the communication with the refuge bay controller, and the controller monitored operations.

6. The combination of claim 2, wherein said controller electronic means includes means for activating the alarm means and communicating with the control room following a predetermined time interval after the door means is opened if the panic means or the test means are not operated.

7. A refuge bay monitoring system for an underground mine comprising:

an above-ground rescue/safety control room having a radio system connected to a monitoring computer, a refuge bay system for monitoring the conditions in a below-ground refuge bay and for generating alarm signals for and providing communication with said control room, wherein the refuge bay includes at least one door, a detector for detecting whether the door is open or closed, a carbon monoxide detector for detecting carbon monoxide levels, a fan operable in connection with a fresh air vent to provide fresh air to the refuge bay, and a controller for monitoring the door detector, the carbon monoxide detector, and the fan, said controller including a panic button, a test button, and voice communication means and programmed to periodically check the status of the door detector, the fan, and the carbon monoxide detector and transmit through a radio system the status to the control room, and to transmit to the control room the status upon operating the panic button or the test button.

* * * * *